US006899172B2

(12) United States Patent
McLeod et al.

(10) Patent No.: US 6,899,172 B2
(45) Date of Patent: May 31, 2005

(54) ABRASION RESISTANT FRAC HEAD

(76) Inventors: Roderick D. McLeod, 916 Burley Drive, Edmonton, Alberta (CA), T6R 1X4; Jerry A. Johnson, 4719-78A St. Close, Red Deer, Alberta (CA), T4P 2G9

( * ) Notice: Subject to any disclaimer, the term of this patent is extended or adjusted under 35 U.S.C. 154(b) by 102 days.

(21) Appl. No.: 10/461,688

(22) Filed: Jun. 16, 2003

(65) Prior Publication Data

US 2004/0251018 A1 Dec. 16, 2004

(30) Foreign Application Priority Data

Mar. 6, 2003 (CA) ..... 2430784

(51) Int. Cl.[7] ..... E21B 33/03
(52) U.S. Cl. ..... 166/90.1; 166/95.1
(58) Field of Search ..... 166/90.1, 95.1, 166/85.4, 72, 383, 379, 77.4

(56) References Cited

U.S. PATENT DOCUMENTS 4,169,504 A * 10/1979 Scott ..... 166/90.1
4,832,128 A * 5/1989 Light et al. ..... 166/377
5,012,865 A 5/1991 McLeod
6,364,024 B1 * 4/2002 Dallas ..... 166/379
6,575,247 B2 * 6/2003 Tolman et al. ..... 166/305.1

FOREIGN PATENT DOCUMENTS

CA 1281280 3/1991

* cited by examiner

*Primary Examiner*—Frank Tsay

(57) ABSTRACT

A frac head comprising a main body with plural side entries oriented around the main body such that flow from each of the side entries meets flow from an opposing side entry in the internal bore. A replaceable abrasion resistant wear sleeve is secured in the internal bore of the main body downstream of the side entries and positioned to intercept flow from the side entries and prevent the flow from impacting directly on material of the main body. The side entries terminate at the internal bore equidistantly from the lower end of the main body, and are symmetrically arranged around the main body. The side entries are oriented at about 45° to the downstream direction. The replaceable abrasion resistant wear sleeve is held against movement downstream by abutment of a shoulder on the replaceable abrasion resistant wear sleeve against a shoulder on the frac body, and has a tapered internal bore.

18 Claims, 5 Drawing Sheets

ABRASION RESISTANT FRAC HEAD

BACKGROUND OF THE INVENTION

In the field of oil well servicing, the practice of fracturing a well is a standard procedure. During this fracturing procedure, large amounts of abrasive fluid-solids mixtures are pumped down the well by high pressure pumps. The frac head is attached to the well head or other fixture located on the well head and fluid lines from the high pressure pumps are attached to the frac head. The frac head acts as a collector for all the fluid lines and directs the fluid from the fluid lines through the well head or well head fixtures and down the well bore. The interior bore of the frac head is subjected to extreme erosion from the abrasive materials mixed with the fluid being pumped. When erosion of the frac head wall material, usually steel, reaches a certain point, the frac head will no longer have the strength required to contain the pressure of the materials being pumped through it and it must be taken out of service and repaired if possible. The repairs, generally by welding, can be difficult and sometimes impossible due to metallurgical problems with welding and the frac head must be scrapped.

The design of frac heads ranges from small dual inlet frac heads in the 1960s to multi inlet frac heads of the present day. The erosion problem has been addressed by means of fabricating the frac head from thick walled steel, using high strength construction materials, weld-coating the inside of the frac head with erosion resisting material, coating the inside with ceramic materials and altering the geometry of the inlets to the frac head. Due to restrictions on the size of the frac head and restrictions on the materials of fabrication, the aforementioned designs have met with minimal success.

SUMMARY OF THE INVENTION

According to an aspect of the invention, the frac head design utilises a replaceable abrasion resistant wear sleeve and thus solves the erosion problems of abrasive wear on the pressure retaining walls of the frac head. The materials of construction for the frac head can thus be selected for ease of fabrication, chemical resistance, and for welding compatibility. This leads to lower initial costs for the frac head, easy visual checking of wear accumulation, in field repair of a worn frac head sleeve and greater reliability of the frac head in service.

There is therefore provided according to an aspect of the invention, a frac head comprising a main body with plural side entries oriented around the main body such that flow from each of the side entries meets flow from an opposing side entry in the internal bore. A replaceable abrasion resistant wear sleeve is secured in the internal bore of the main body downstream of the side entries and positioned to intercept flow from the side entries and prevent the flow from impacting directly on material of the main body. The side entries terminate at the internal bore equidistantly from the lower end of the main body, and are symmetrically arranged around the main body. Preferably, the side entries are oriented at about 30° to 45° to the downstream direction. The replaceable abrasion resistant wear sleeve is preferably held against movement downstream by abutment of a shoulder on the replaceable abrasion resistant wear sleeve against a shoulder on the frac body, and preferably has a tapered internal bore. The replaceable abrasion resistant wear sleeve may terminate downward flush with a lower face of the main body.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

Figure 1A:
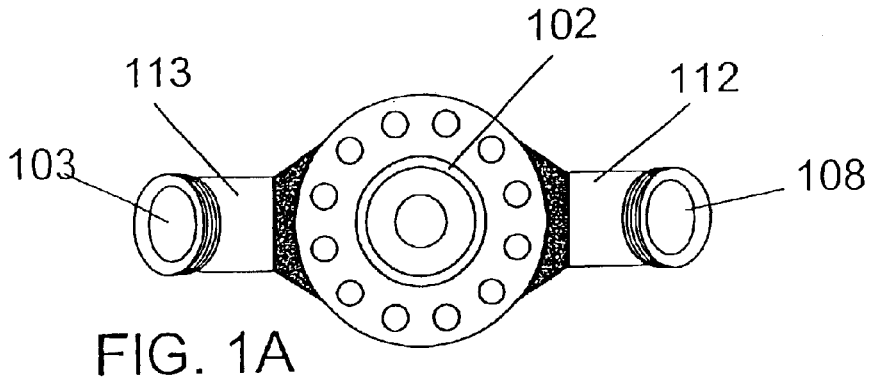
FIGS. 1A and 1 are respectively a top view and side cross section of a conventional three port frac head showing a top entry and two side entries and a representation of fluid flow.
Figure 1:
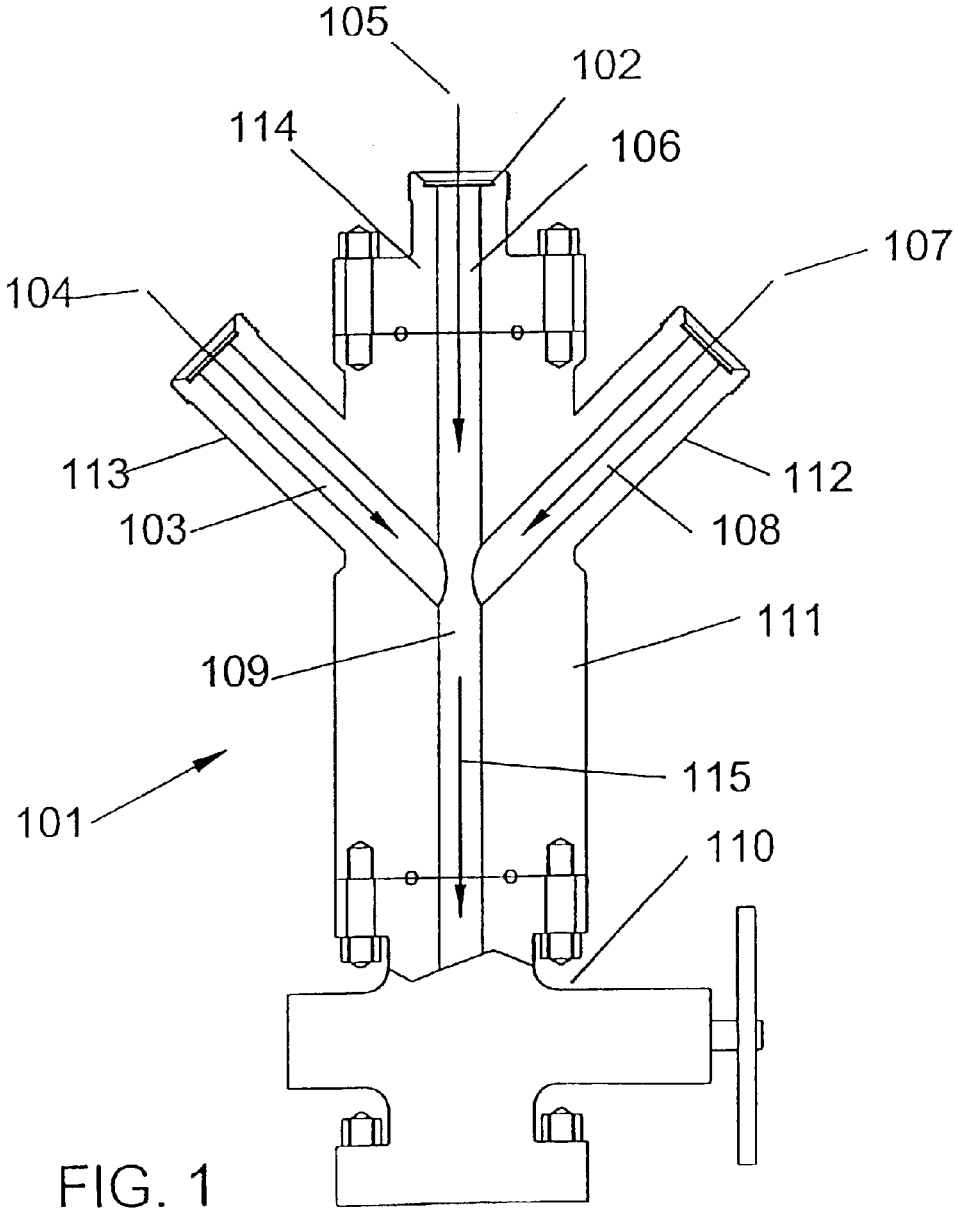

FIGS. 1A and 1 illustrate a frac head 101 of the usual type used over the past fifty years in the oil field practice of fracturing an oil or gas well. The frac head 101 is comprised of a main body 111, a cap 114, top entry 102, side entries 113 and 112 and internal channels 108, 103, 109 and 106. An abrasive fluid motion is shown as arrows 104, 105 and 107 and the combined flow 115. A well head valve is shown at 110. The top view of the frac head is noted at 102. This particular configuration is called a three port frac head.

Figure 2A:
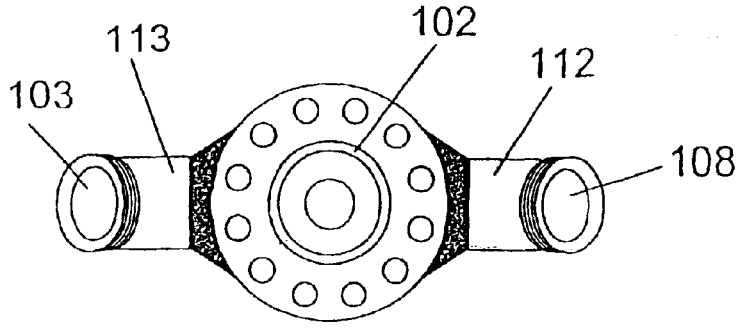
FIGS. 2A and 2 are respectively a top view and side cross section of a three port frac head illustrating the abrasion of the central cavity by the fluids.
Figure 2:
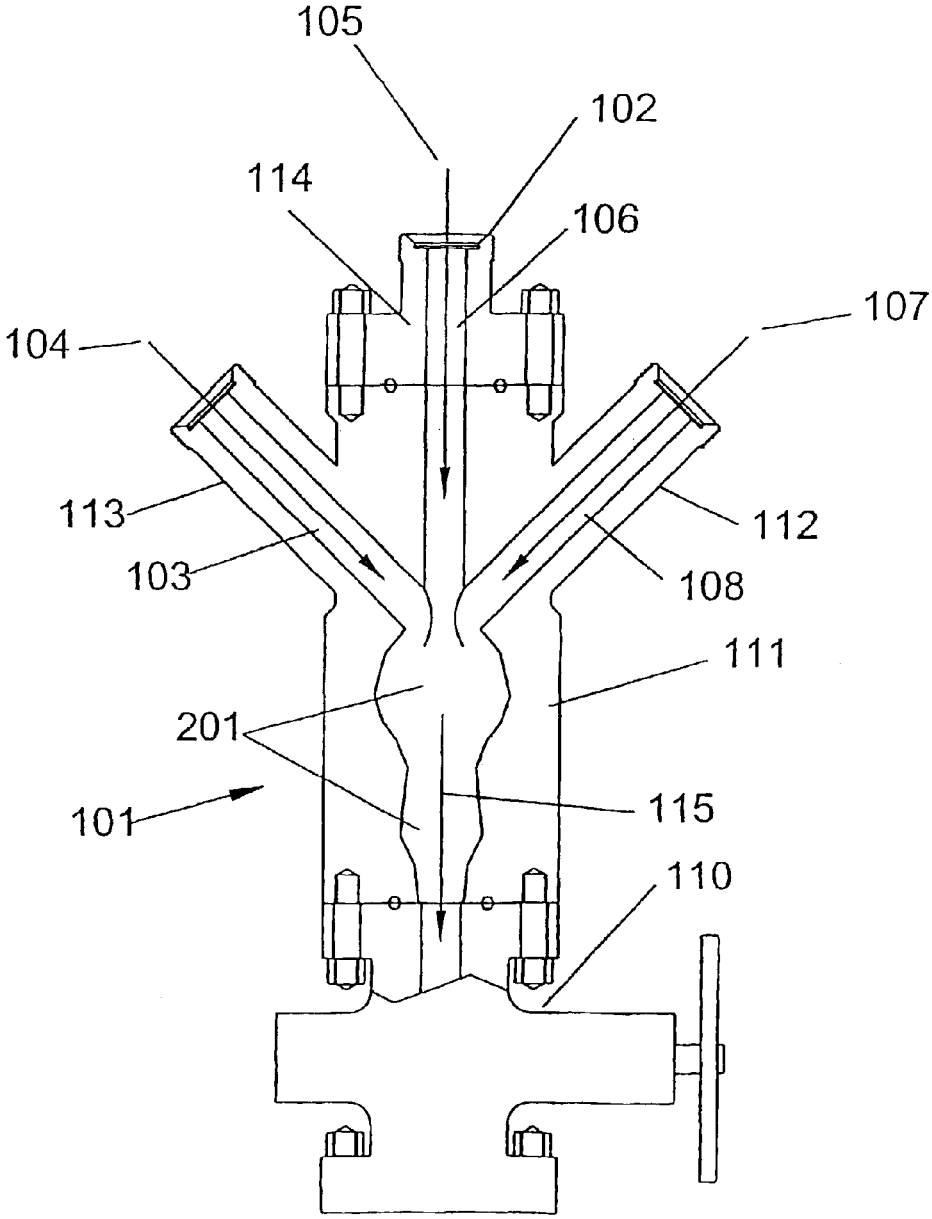

FIGS. 2A and 2 illustrate the same frac head as in FIGS. 1A and 1, showing the area 201 in the frac head where erosion takes place due to the abrasive action of the fluid flowing through the channels and impinging on the channel walls.

Figure 3A:
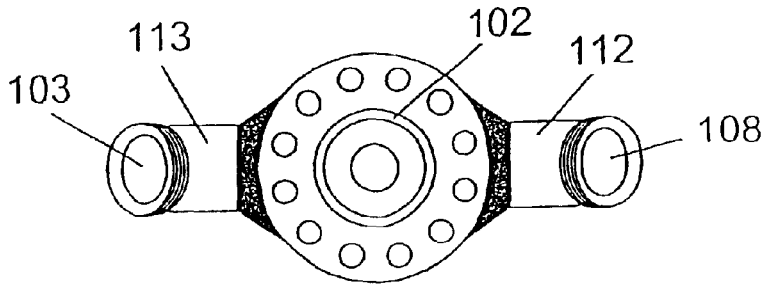
FIGS. 3A and 3 are respectively a top view and side cross section of a three port frac head according to a first embodiment of the invention showing a conical, removable abrasion resistant sleeve.
Figure 3:
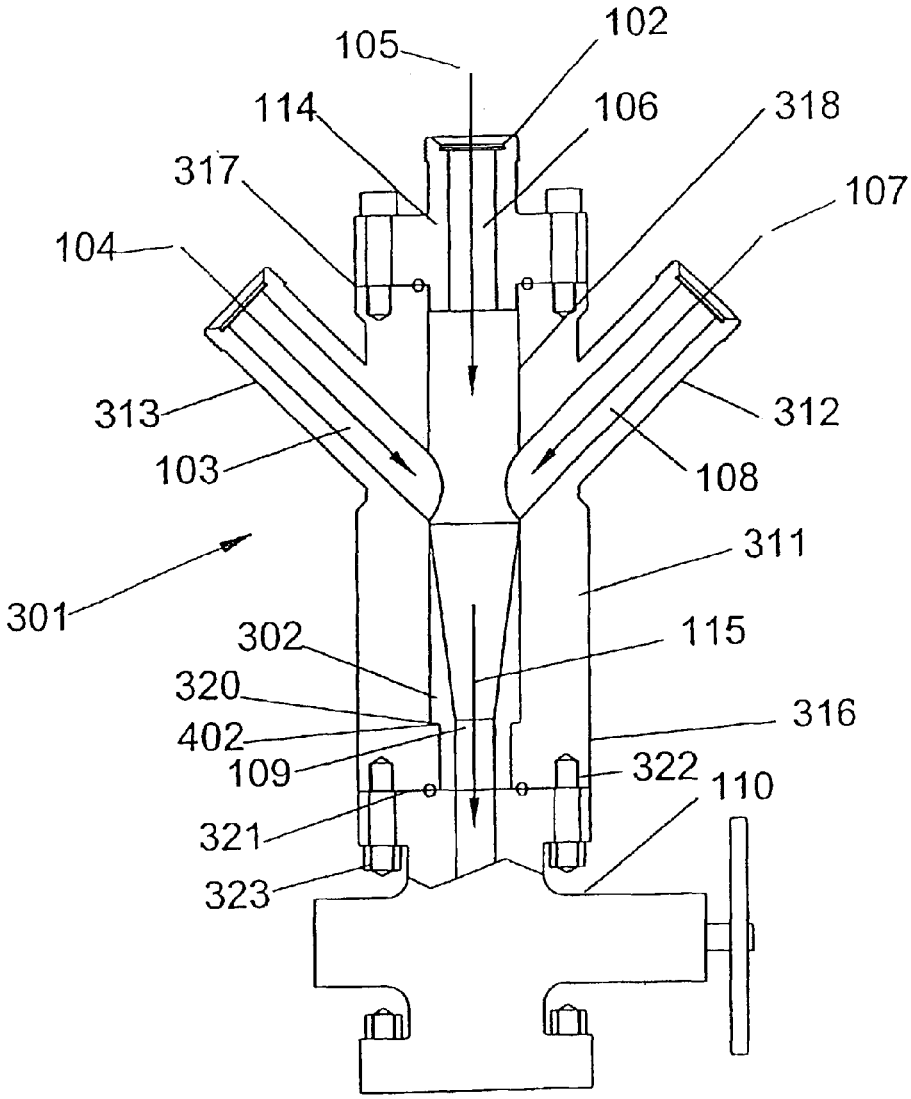
Figure 4A:
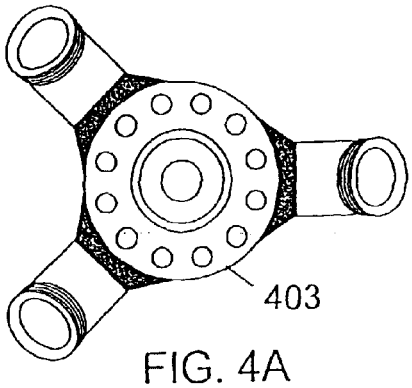
FIGS. 4, 4A and 4B are respectively a side view cross section of an abrasion resistant sleeve according to the invention and top views of four port and five port configurations of the frac head.
Figure 4B:
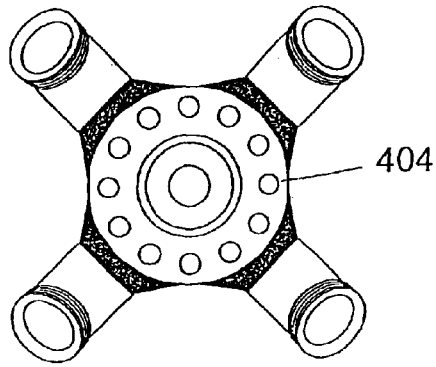

FIG. 3 illustrates a frac head 301 according to the invention with a replaceable abrasion resistant wear sleeve 302 in place. The frac head 301 has a main body 311 with a lower end 316, an upper end 317, and an internal bore 318 holding the wear sleeve 302. Plural side entries 312, 313, of conventional construction, are oriented around the main body 311 such that flow from each of the side entries 312, 313 meets flow from an opposing side entry in the internal bore 318. FIGS. 4A and 4B show two further possible configurations that produce this result. Frac head 403 has three side entries and frac head 404 has four side entries. Many different configurations are possible. The opposing flows from the side entries 312, 313 help to reduce lateral flow velocity of the fluid injected into the frac head 301 and thus reduce wear. The side entries 312, 313 are oriented to produce a flow in a downstream direction through the internal bore 318 towards the lower end 316 of the main body 311. The replaceable abrasion resistant wear sleeve 302 is secured in the internal bore 318 downstream of the side entries 312, 313. Due to the orientation of the side entries 312, 313, and the proximity of the upper edge of the wear sleeve 302, the wear sleeve 302 is positioned to intercept flow from the side entries 312, 313 and prevent the flow from impacting directly on material of the main body 311.

For optimum reduction of lateral flow reduction of fluid injected through the side entries 312, 313 into the internal bore 318, it is preferred that the side entries 312, 313 terminate at the internal bore 318 equidistantly from the lower end 316 of the main body 311 as illustrated. Similarly, the side entries 312, 313 are preferably symmetrically arranged around the main body 311. Symmetrically arranged in this context means arranged so that the net lateral flow of all the flows from the side entries 312, 313 is zero. The side entries 312, 313 could be uniformly spaced around the main body 311 as in FIGS. 3A and 4B, but also could be symmetrical about a single axis as shown in FIG. 4A.

Preferably, the side entries 312, 313 are oriented at an angle of 30° to 45°, or at least between 15° and 60°, to the downstream direction. Too low an angle, for example 0° results in wear of the openings of the side entries 312, 313 into the internal bore 318 due to uneven flow in the side entries 312, 313. Too high an angle of the side entries 312, 313 makes them difficult to work with.

Figure 4:
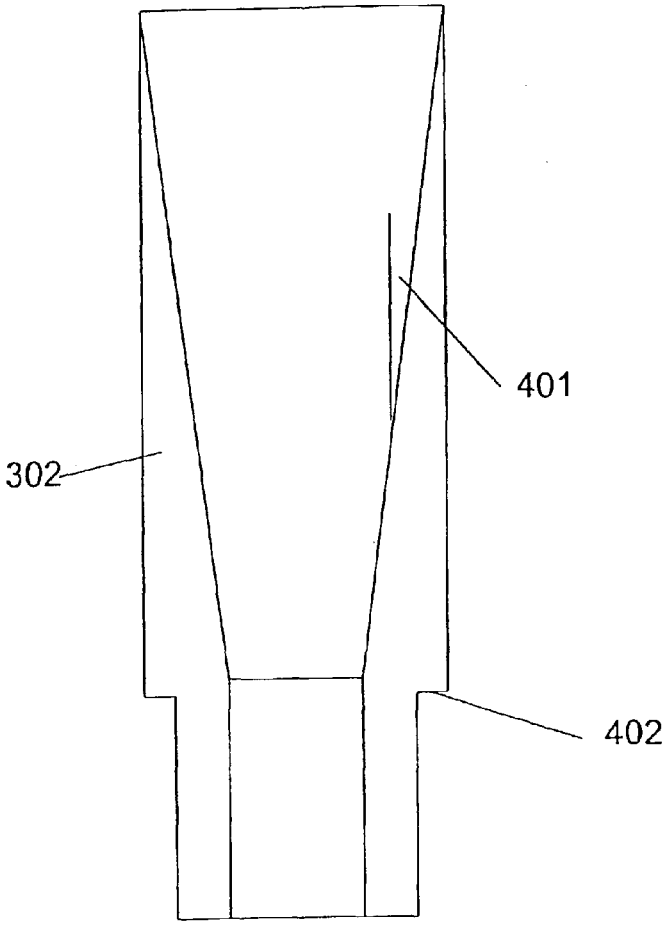

The replaceable abrasion resistant wear sleeve 302 is held against movement downstream by abutment of a shoulder 402 (FIG. 4) on the replaceable abrasion resistant wear sleeve 302 against a corresponding shoulder 320 on the frac body 311. When the wear sleeve 302 is installed, an adhesive such as Bakerloc™ may be applied on the shoulder 402 to initially hold the sleeve from movement in the upward direction. After an initial frac job, the sleeve 302 is held in place by friction, as small particles of sand fit between the sleeve 302 and the bore 318 of the frac head. The replaceable abrasion resistant wear sleeve 302 preferably has a tapered internal bore, being narrower in the downstream direction, with the taper angle 401 (FIG. 4) being about 10° to 20°, depending on the flow rate, with about 14–15° being preferred for a flow rate of 80 ft/sec, and generally shallower angles for faster flow rates. The shoulder 402 is produced by an inward step on the outer surface of the replaceable abrasion resistant wear sleeve 302.

The main body 311 has a face 321 at the lower end 316 that incorporates openings 322 for receiving fasteners 323 to secure the main body 311 on a wellhead 110. The replaceable abrasion resistant wear sleeve 302 preferably terminates downward flush with the face 321. The upper edge of the wear sleeve 302 preferably terminates upwardly flush with lower edges of the internal channels of the side entries 312, 313.

Figure 5:
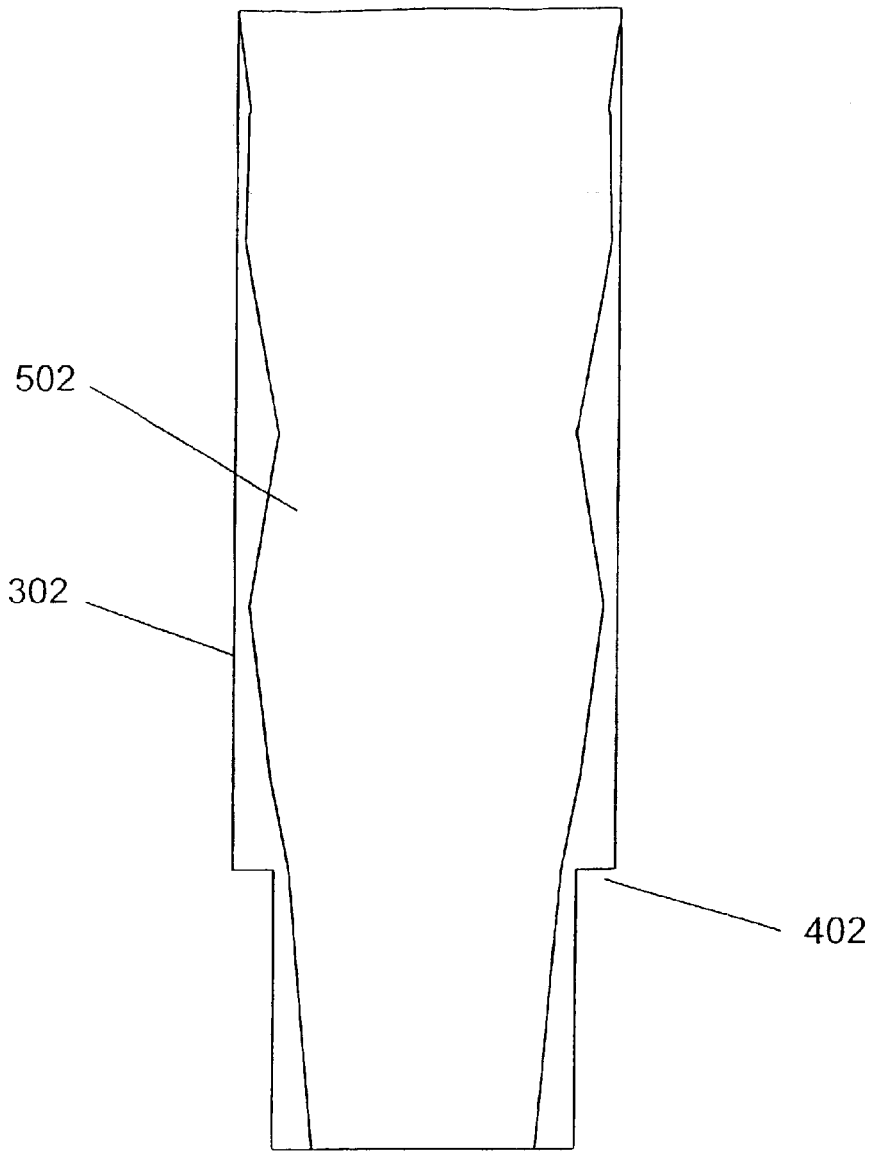
FIG. 5 is a side view cross section of an abrasion resistant sleeve according to the invention with abrasive wear shown.

The wear sleeve 302 may be made of EN30B high strength steel available from British Steel Alloys or other suitable abrasion resistant steel such as Astralloy™. A typical sleeve 302 may be 15" long, with the shoulder at 3" and the outer diameter reducing from 6" to 3" at the step. The internal bore at the lower end may be 2¾" in diameter. FIG. 5 illustrates the replaceable abrasion resistant wear sleeve 302 with a wear pattern 501 like that observed in experiments. When the wear sleeve 302 becomes too thin to be useful, it may be removed readily from the frac head between frac operations and replaced with a new wear sleeve 302.

A person skilled in the art could make immaterial modifications to the invention disclosed without departing from the invention.

What is claimed is:

1. A frac head, comprising:

a main body having a lower end, an upper end, and an internal bore;

plural side entries oriented around the main body such that flow from each of the side entries meets flow from an opposing side entry in the internal bore;

the plural side entries being oriented to produce a flow in a downstream direction through the internal bore towards the lower end of the main body; and a replaceable abrasion resistant wear sleeve secured in the internal bore downstream of the side entries and positioned to intercept flow from the side entries and prevent the flow from impacting directly on material of the main body.

2. The frac head of claim 1 in which the side entries terminate at the internal bore equidistantly from the lower end of the main body.

3. The frac head of claim 1 in which the side entries are symmetrically arranged around the main body.

4. The frac head of claim 1 in which the side entries are uniformly spaced around the main body.

5. The frac head of claim 1 in which the side entries are oriented at an angle of between 15° and 60° to the downstream direction.

6. The frac head of claim 5 in which the side entries are oriented at an angle of between 30° and 45° to the downstream direction.

7. The frac head of claim 1 in which the replaceable abrasion resistant wear sleeve is held against movement downstream by abutment of a shoulder on the replaceable abrasion resistant wear sleeve against a shoulder on the frac body.

8. The frac head of claim 1 in which the replaceable abrasion resistant wear sleeve has a sleeve internal bore, and the sleeve internal bore is tapered, being narrower in the downstream direction.

9. The frac head of claim 7 in which the replaceable abrasion resistant wear sleeve has an outer surface, and the outer surface has an inward step forming the shoulder on the replaceable abrasion resistant wear sleeve.

10. The frac head of claim 8 in which the tapered sleeve internal bore is tapered at an angle between 10° and 20° to the downstream direction.

11. The frac head of claim 1 in which:

the main body has a face at the lower end that incorporates openings for receiving fasteners to secure the main body on a wellhead; and the replaceable abrasion resistant wear sleeve terminates downward flush with the face.

12. The frac head of claim 1 in which the side entries have internal channels and the replaceable abrasion resistant wear sleeve terminates upwardly flush with lower edges of the internal channels of the side entries.

13. A frac head, comprising:

a main body having a lower end, an upper end, and an internal bore;

plural side entries distributed around the main body to provide flow into the internal bore;

the plural side entries being oriented to produce a flow in a downstream direction through the internal bore towards the lower end of the main body; and a replaceable abrasion resistant wear sleeve secured in the internal bore downstream of the side entries and positioned to intercept flow from the side entries and prevent the flow from impacting directly on material of the main body.

14. The frac head of claim 13 in which the side entries are oriented at an angle of 45° to the downstream direction.

15. The frac head of claim 14 in which the replaceable abrasion resistant wear sleeve is held against movement downstream by abutment of a shoulder on the replaceable abrasion resistant wear sleeve against a shoulder on the frac body.

16. The frac head of claim 15 in which the replaceable abrasion resistant wear sleeve has a sleeve internal bore, and the sleeve internal bore is tapered, being narrower in the downstream direction.

17. The frac head of claim 16 in which the taper of the sleeve internal bore is between 10° and 20° to the downstream direction.

18. The frac head of claim 17 in which:

the main body has a face at the lower end that incorporates openings for receiving fasteners to secure the main body on a wellhead; and the replaceable abrasion resistant wear sleeve terminates downward flush with the face.

* * * * *